US008454008B2

(12) United States Patent
Lan et al.

(10) Patent No.: US 8,454,008 B2
(45) Date of Patent: Jun. 4, 2013

(54) RETARD ROLLER AND RETARD ROLLER MODULE HAVING SUCH RETARD ROLLER WITH SOFT ELEMENTS

(71) Applicant: Primax Electronics Ltd., Taipei (TW)

(72) Inventors: Chia-Tsui Lan, Taipei (TW); Ping-Hung Kuo, Taipei (TW); Yi-Liang Chen, Taipei (TW)

(73) Assignee: Primax Electronics Ltd., Teipei (TW)

( * ) Notice: Subject to any disclaimer, the term of this patent is extended or adjusted under 35 U.S.C. 154(b) by 0 days.

(21) Appl. No.: 13/645,979

(22) Filed: Oct. 5, 2012

(65) Prior Publication Data

US 2013/0026700 A1 Jan. 31, 2013

Related U.S. Application Data

(62) Division of application No. 12/777,976, filed on May 11, 2010, now Pat. No. 8,308,155.

(30) Foreign Application Priority Data

Feb. 12, 2010 (TW) ..... 99104589 A

(51) Int. Cl.
*B65H 3/52* (2006.01)

(52) U.S. Cl.
CPC ..... *B65H 3/5246* (2013.01)
USPC ..... 271/125

(58) Field of Classification Search
USPC ..... 271/125
See application file for complete search history.

(56) References Cited

U.S. PATENT DOCUMENTS

| | | | | |
|---|---|---|---|---|
| 5,669,605 | A * | 9/1997 | Sawa et al. | 271/109 |
| 6,055,407 | A * | 4/2000 | Inoue et al. | 271/119 |
| 6,585,252 | B1 * | 7/2003 | Russo et al. | 271/125 |
| 6,758,468 | B2 * | 7/2004 | DaCunha et al. | 271/124 |
| 6,769,679 | B2 * | 8/2004 | Ishibashi | 271/125 |
| 6,962,333 | B2 * | 11/2005 | Mizuno et al. | 271/125 |
| 7,222,570 | B2 * | 5/2007 | Kawamura et al. | 271/109 |
| 7,386,249 | B2 * | 6/2008 | Bethel et al. | 399/105 |

FOREIGN PATENT DOCUMENTS

| | | | |
|---|---|---|---|
| JP | 02062335 | A * | 3/1990 |
| JP | 2010155679 | A * | 7/2010 |

* cited by examiner

*Primary Examiner* — Gerald McClain
(74) *Attorney, Agent, or Firm* — Kirton McConkie; Evan R. Witt

(57) ABSTRACT

A retard roller and a retard roller module are provided. The retard roller is used in an automatic document feeder for providing a frictional force to separate plural documents from each other. Unidirectional rotation of the retard roller is permitted. Due to the unidirectional rotation, the contact surface of the retard roller can be switched. During the sheet-feeding process, the document is contacted with a specified contact surface. By rotating the retard roller, the document is contacted with another contact surface.

6 Claims, 11 Drawing Sheets

1

3

RETARD ROLLER AND RETARD ROLLER MODULE HAVING SUCH RETARD ROLLER WITH SOFT ELEMENTS

CROSS-REFERENCE TO RELATED APPLICATION

This application is a divisional of prior application Ser. No. 12/777,976, filed May 11, 2010, which is incorporated by reference.

FIELD OF THE INVENTION

The present invention relates to a retard roller, and more particularly to a retard roller for use in an automatic document feeder.

BACKGROUND OF THE INVENTION

Generally, an automatic document feeder is usually integrated into the scanning apparatus for successively scanning a stack of documents. The automatic document feeder has a sheet input tray for placing the stack of documents. The automatic document feeder also has a sheet pick-up module for successively feeding the stack of documents from a sheet input tray to the internal portion of the automatic document feeder in a sheet-feeding direction. For allowing only one document to be fed into the internal portion of the automatic document feeder at each feeding time, the sheet pick-up module has a sheet separation roller and a separation pad. The separation pad is disposed under the sheet separation roller. The sheet separation roller may provide a frictional force to the document that is contacted with the separation pad. The frictional forces between the sheet pick-up module, the separation pad and the documents should be elaborately controlled. Generally, the frictional force between the sheet pick-up module and the document contacted with the sheet pick-up module is greater than the frictional force between the documents. In addition, the frictional force between the separation pad and the document contacted with the separation pad is also greater than the frictional force between the documents. As a consequence, only one document is allowed to be fed into the internal portion of the automatic document feeder at each feeding time. As the automatic document feeder is used for a long time, the separation pad is usually abraded, or even losses the function of separating documents.

For solving the above drawbacks, an automatic document feeder is disclosed. Such an automatic document feeder has a retard roller in replace of the separation pad. The function of the retard roller is similar to the separation pad. Generally, the retard roller is advantageous over the separation pad. When the document is transported across the region between the sheet pick-up module and the retard roller, the retard roller is rotated as the document is transported across the region. As such, different zones of the retard roller are abraded by the document for different feeding times. Due to the rotation of the retard roller, the abraded zones of the retard roller are distributed over the retard roller. Whereas, the separation pad has a specified abrade zone. As a consequence, the retard roller has a longer user life than the separation pad.

However, the retard roller and the separation pad have the similar drawbacks. For example, there is no mechanism for prompting the abraded condition of the retard roller or the separation pad. In a case that the retard roller or the separation pad is seriously abraded and has malfunction, the use of the retard roller or the separation pad may increase the possibility of causing the double feeding problem. Until the user finds that the retard roller or the separation pad is seriously abraded, several double feeding events have occurred, and some documents are not successfully scanned. The process of checking the double-fed documents is time-consuming. In addition, it is also the time-consuming and troublesome to re-scan the double-fed documents.

SUMMARY OF THE INVENTION

An object of the present invention provides a retard roller whose abraded zone is switchable.

Another object of the present invention provides a retard roller having a function of indicating the abraded condition thereof.

A further object of the present invention provides an easily disassembled/assembled retard roller module.

In accordance with an aspect of the present invention, there is provided a retard roller of an automatic document feeder for providing a frictional force to separate a first document and a second document from each other. The first document lies on the first document. The retard roller is disposed in a feeder cover of the automatic document feeder. The feeder cover includes a retard roller receptacle and a receiving structure beside the retard roller receptacle. The retard roller includes a rotating shaft, a switching wheel, a stopping rod and a retard sleeve member. The rotating shaft is disposed within the retard roller receptacle and rotatable with respect to the feeder cover. The switching wheel is disposed beside the rotating shaft, connected to the rotating shaft, and synchronously rotated with the rotating shaft. The switching wheel has a first locking region and a second locking region. The stopping rod is disposed within the receiving structure, and includes a confining part. The confining part is inserted into the first locking region or the second locking region of the switching wheel. The confining part is blocked by a blocking part, so that the stopping rod is hindered from rotating in a first rotating direction. The retard sleeve member is sheathed around the rotating shaft, and has a first contact surface exposed outside the retard roller receptacle. When the first document and the second document are transported into the automatic document feeder, the retard sleeve member is contacted with the second document to generate the frictional force. When the second document is moved in a sheet-feeding direction, the stopping rod is blocked by the blocking part to hinder the rotating shaft from rotating in the first rotating direction, so that the first contact surface is still exposed outside the retard roller receptacle. When the rotating shaft is rotated in a second rotating direction reverse to the first rotating direction, the stopping rod is rotated in the second rotating direction in response to rotation of the rotating shaft, and the confining part is moved from the first locking region to the second locking region, so that a second contact surface is exposed outside the retard roller receptacle.

In an embodiment, the feeder cover further includes a position-limiting hole, which is formed in a receptacle sidewall between the receiving structure and the retard roller receptacle. A position-limiting hole sidewall of the position-limiting hole is served as the blocking part for hindering the stopping rod from rotating in the first rotating direction.

In an embodiment, the retard sleeve member further includes a first-layered retard sleeve and a second-layered retard sleeve. The second-layered retard sleeve is enclosed by the first-layered retard sleeve. The first contact surface and the second contact surface are arranged on the first-layered retard sleeve.

In an embodiment, the retard roller further includes plural soft elements, which are disposed on the rotating shaft and contacted with the retard sleeve member for increasing a contact area between the second document and the retard sleeve member.

In an embodiment, each of the soft elements has a rectangular shape, and is made of sponge, soft rubbery material, ethylene vinyl acetate (EVA) material or ethylene propylene diene (EPDM) material.

In an embodiment, the rotating shaft further includes plural grooves for receiving corresponding soft elements.

In an embodiment, the switching wheel includes a D-shaped pivotal hole, a saw-toothed surface and plural locking posts. The rotating shaft is penetrated through the D-shaped pivotal hole, so that the switching wheel and the rotating shaft are connected with each other and the switching wheel is synchronously rotated with the rotating shaft. The saw-toothed surface provides a surface frictional force to facilitate a user to rotate the switching wheel. The plural locking posts are used for forming the first locking region and the second locking region. The plural locking posts are sustained against the confining part to confine a rotating range of the switching wheel, so that only the first contact surface of the retard sleeve member is exposed outside the retard roller receptacle.

In an embodiment, the plural locking posts include a first locking post, a second locking post, a third locking post and a fourth locking post. The first locking post and the second locking post collectively define the first locking region. The second locking post and the third locking post collectively define the second locking region. The third locking post has a first mark. The fourth locking post has a second mark. When the first mark is aligned with a cover mark of the feeder cover, the first contact surface of the retard sleeve member is exposed outside the retard roller receptacle. When the second mark is aligned with the cover mark of the feeder cover, the second contact surface is exposed outside the retard roller receptacle.

In accordance with another aspect of the present invention, there is provided a retard roller module of an automatic document feeder for providing a frictional force to separate a first document and a second document from each other. The first document lies on the second document. The retard roller is disposed in a feeder cover of the automatic document feeder. The feeder cover includes a retard roller module receptacle and a receiving structure beside the retard roller module receptacle. The retard roller module includes a module casing, a rotating shaft, a switching wheel, a stopping rod and a retard sleeve member. The module casing is disposed within the retard roller module receptacle. The rotating shaft is disposed within the module casing and rotatable with respect to the module casing. The switching wheel is disposed beside the rotating shaft, connected to the rotating shaft, and synchronously rotated with the rotating shaft. The switching wheel has a first locking region and a second locking region. The stopping rod is disposed within the receiving structure, and comprising a confining part. The confining part is inserted into the first locking region or the second locking region of the switching wheel. The confining part is blocked by a blocking part, so that the stopping rod is hindered from rotating in a first rotating direction. The retard sleeve member is sheathed around the rotating shaft, and having a first contact surface exposed outside the retard roller module receptacle. When the first document and the second document are transported into the automatic document feeder, the retard sleeve member is contacted with the second document to generate the frictional force. When the second document is moved in a sheet-feeding direction, the stopping rod is blocked by the blocking part to hinder the rotating shaft from rotating in the first rotating direction, so that the first contact surface is still exposed outside the retard roller module receptacle. When the rotating shaft is rotated in a second rotating direction reverse to the first rotating direction, the stopping rod is rotated in the second rotating direction in response to rotation of the rotating shaft, and the confining part is moved from the first locking region to the second locking region, so that a second contact surface is exposed outside the retard roller module receptacle.

In an embodiment, the feeder cover further includes a position-limiting hole, which is formed in a receptacle sidewall between the receiving structure and the retard roller module receptacle. A position-limiting hole sidewall of the position-limiting hole is served as the blocking part for hindering the stopping rod from rotating in the first rotating direction.

In an embodiment, the retard sleeve member further includes a first-layered retard sleeve and a second-layered retard sleeve. The second-layered retard sleeve is enclosed by the first-layered retard sleeve. The first contact surface and the second contact surface are arranged on the first-layered retard sleeve.

In an embodiment, the retard roller module further includes plural soft elements, which are disposed on the rotating shaft and contacted with the retard sleeve member for increasing a contact area between the second document and the retard sleeve member.

In an embodiment, each of the soft elements has a rectangular shape, and is made of sponge, soft rubbery material, ethylene vinyl acetate (EVA) material or ethylene propylene diene (EPDM) material.

In an embodiment, the rotating shaft further includes plural grooves for receiving corresponding soft elements.

In an embodiment, the switching wheel includes a D-shaped pivotal hole, a saw-toothed surface and plural locking posts. The rotating shaft is penetrated through the D-shaped pivotal hole, so that the switching wheel and the rotating shaft are connected with each other and the switching wheel is synchronously rotated with the rotating shaft. The saw-toothed surface provides a surface frictional force to facilitate a user to rotate the switching wheel. The plural locking posts are used for forming the first locking region and the second locking region. The plural locking posts are sustained against the confining part to confine a rotating range of the switching wheel, so that only the first contact surface of the retard sleeve member is exposed outside the retard roller module receptacle.

In an embodiment, the plural locking posts include a first locking post, a second locking post, a third locking post and a fourth locking post. The first locking post and the second locking post collectively define the first locking region. The second locking post and the third locking post collectively define the second locking region. The third locking post has a first mark. The fourth locking post has a second mark. When the first mark is aligned with a cover mark of the feeder cover, the first contact surface of the retard sleeve member is exposed outside the retard roller module receptacle. When the second mark is aligned with the cover mark of the feeder cover, the second contact surface is exposed outside the retard roller module receptacle.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
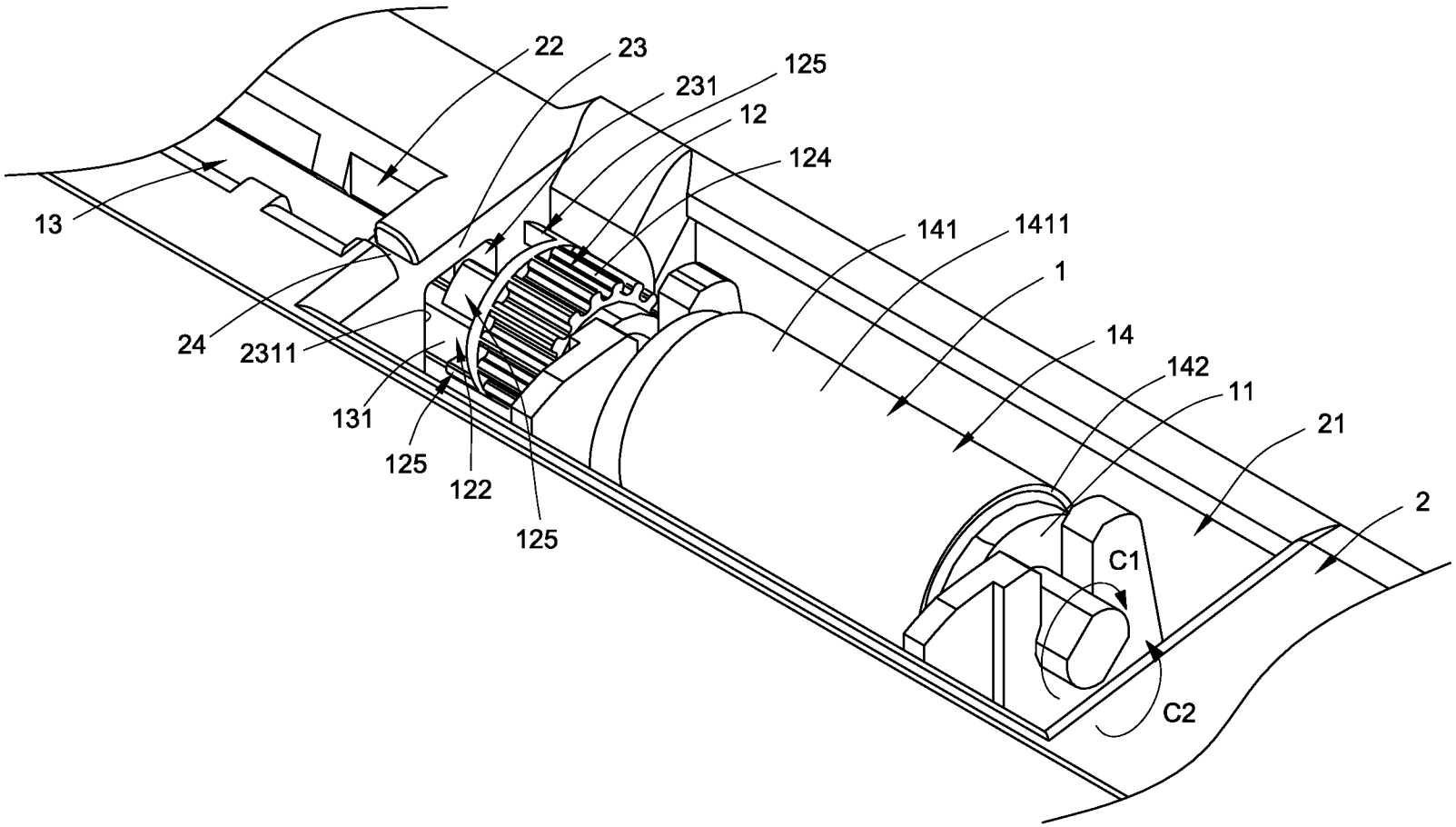
FIG. 1 is a schematic cutaway view illustrating a retard roller installed in a feeder cover of an automatic document feeder according to a first embodiment of the present invention.
Figure 2:
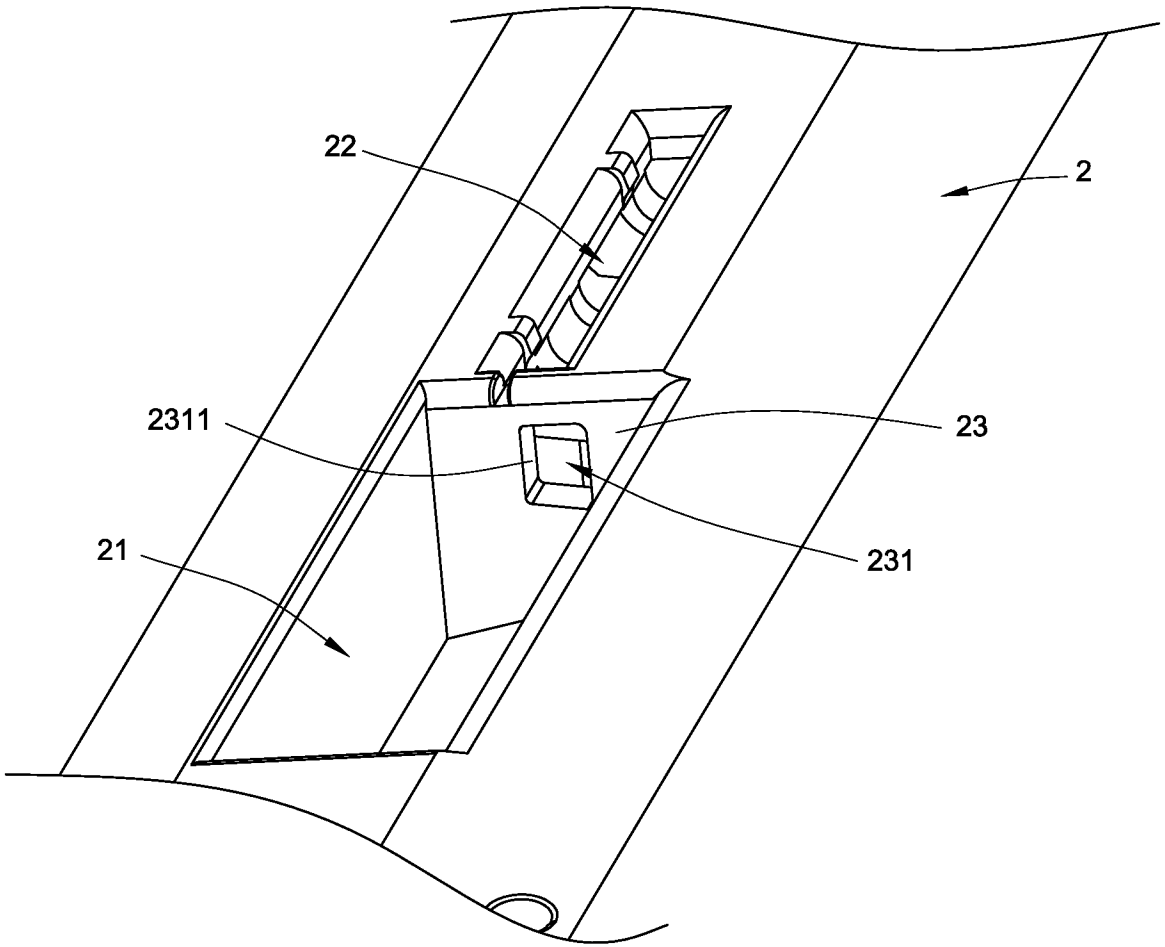
FIG. 2 is a schematic cutaway view illustrating the feeder cover of the automatic document feeder according to the first embodiment of the present invention.

FIG. 1 is a schematic cutaway view illustrating a retard roller installed in a feeder cover of an automatic document feeder according to a first embodiment of the present invention. FIG. 2 is a schematic cutaway view illustrating the feeder cover of the automatic document feeder according to the first embodiment of the present invention. Please refer to FIGS. 1 and 2. The retard roller 1 is installed in the feeder cover 2 of the automatic document feeder. The retard roller 1 comprises a rotating shaft 11, a switching wheel 12, a stopping rod 13 and a retard sleeve member 14. The feeder cover 2 comprises a retard roller receptacle 21, a receiving structure 22 and a receptacle sidewall 23. The receiving structure 22 is arranged beside the retard roller receptacle 21. The receptacle sidewall 23 is arranged between the retard roller receptacle 21 and the receiving structure 22. A position-limiting hole 231 is formed in the receptacle sidewall 23. The position-limiting hole 231 has a blocking part 2311. In this embodiment, the blocking part 2311 is a position-limiting hole sidewall. The retard roller 1 is disposed within the retard roller receptacle 21. The stopping rod 13 of the retard roller 1 is accommodated within the receiving structure 22. The stopping rod 13 is penetrated through the position-limiting hole 231 and connected with the switching wheel 12.

Figure 3:
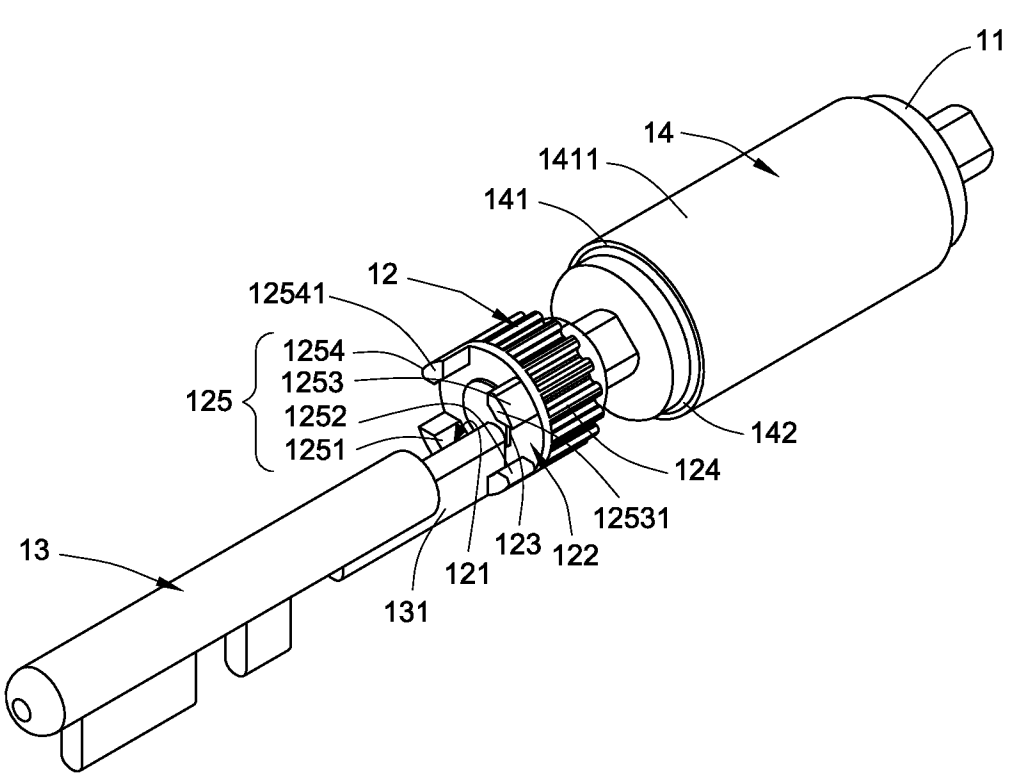
FIG. 3 is a schematic perspective view illustrating the retard roller according to the first embodiment of the present invention.

Hereinafter, the configurations and connecting relations of the components included in the retard roller 1 will be illustrated with reference to FIGS. 1 and 3. FIG. 3 is a schematic perspective view illustrating the retard roller according to the first embodiment of the present invention. In the retard roller 1, the rotating shaft 11 is disposed within the retard roller receptacle 21. The switching wheel 12 is disposed beside the rotating shaft 11, connected to the rotating shaft 11, and synchronously rotated with the rotating shaft 11. The switching wheel 12 comprises a first locking region 121, a second locking region 122, a D-shaped pivotal hole 123, a saw-toothed surface 124 and plural locking posts 125. The rotating shaft 11 is penetrated through the D-shaped pivotal hole 123, so that the switching wheel 12 and the rotating shaft 11 are connected with each other and the switching wheel 12 is synchronously rotated with the rotating shaft 11. The saw-toothed surface 124 may provide a surface frictional force to facilitate the user to rotate the switching wheel 12. The plural locking posts 125 comprise a first locking post 1251, a second locking post 1252, a third locking post 1253 and a fourth locking post 1254. The first locking post 1251 and the second locking post 1252 collectively define the first locking region 121. The second locking post 1252 and the third locking post 1253 collectively define the second locking region 122.

The stopping rod 13 is disposed within the receiving structure 22. The stopping rod 13 comprises a confining part 131. The confining part 131 is inserted into the first locking region 121 or the second locking region 122 of the switching wheel 12. Since the confining part 131 is blocked by the blocking part 2311, the stopping rod 13 is hindered from rotating in a first rotating direction C1. The stopping rod 13 is penetrated through the position-limiting hole 231 and inserted into the switching wheel 12. The retard sleeve member 14 is sheathed around the rotating shaft 11. When the document is transported into the internal portion of the automatic document feeder, the retard sleeve member 14 is contacted with the document to generate a frictional force.

The retard sleeve member 14 comprises a first-layered retard sleeve 141 and a second-layered retard sleeve 142. The second-layered retard sleeve 142 is enclosed by the first-layered retard sleeve 141. The first-layered retard sleeve 141 has a first contact surface 1411 and a second contact surface 1412. The first contact surface 1411 is exposed outside the retard roller receptacle 21 (see FIG. 1). The plural locking posts 125 are sustained against the confining part 131 to confine the rotating range of the switching wheel 12, so that only the first contact surface 1411 of the retard sleeve member 14 is exposed outside the retard roller receptacle 21.

Figure 4:
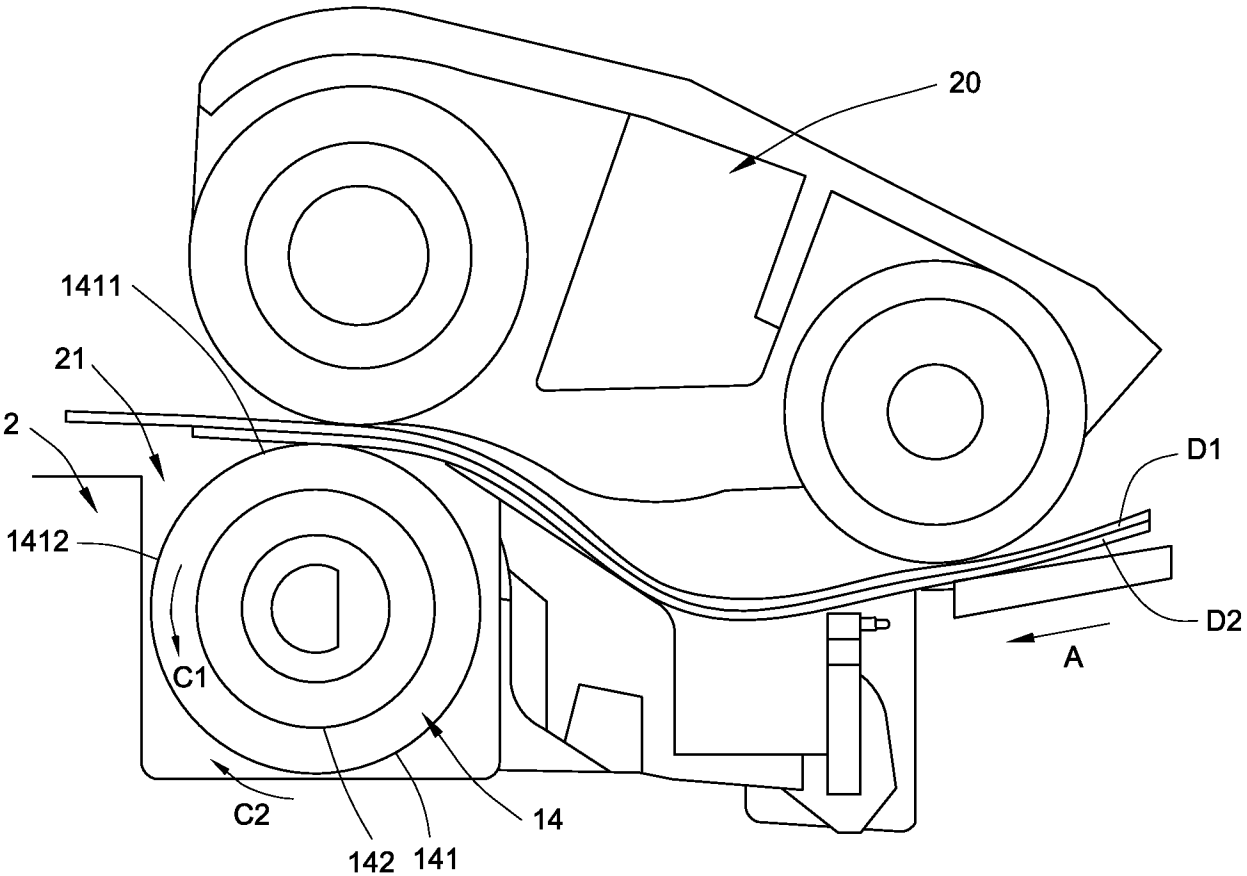
FIG. 4 is a schematic side view illustrating the retard roller in a sheet-feeding status according to the first embodiment of the present invention.

Hereinafter, the operating principles of the retard roller 1 will be illustrated with reference to FIGS. 1 and 4. FIG. 4 is a schematic side view illustrating the retard roller in a sheet-feeding status according to the first embodiment of the present invention. The automatic document feeder comprises a sheet pick-up module 20. When the automatic document feeder is activated, the rollers of the sheet pick-up module 20 are rotated in a second rotating direction C2 to transport a first document D1 and a second document D2. The first document D1 is disposed on the second document D2. The first document D1 is in contact with the sheet pick-up module 20. As the first document D1 and the second document D2 are transported by the sheet pick-up module 20, the first document D1 and the second document D2 are moved in a sheet-feeding direction A. Since the second document D2 is in contact with the first contact surface 1411 of the retard sleeve member 14, the retard roller 1 provides a frictional force to the second document D2. Due to the frictional force, the first document D1 and the second document D2 could be separated from each other. Moreover, during the process of transporting the first document D1 and the second document D2, the confining part 131 of the stopping rod 13 is blocked by the blocking part 2311, so that the stopping rod 13 is hindered from rotating in the first rotating direction C1. In other words, as the second document D2 is moved, the retard roller 1 is not rotated in the first rotating direction C1. During the process of transporting the first document D1 and the second document D2, only the first contact surface 1411 of the retard sleeve member 14 is abraded.

Since the retard roller 1 fails to be rotated in the first rotating direction C1, the abraded zone of the retard sleeve member 14 is restricted to the first contact surface 1411. In other words, the area excluding the first contact surface 1411 is not abraded. Until the first contact surface 1411 is seriously abraded and fails to be normally operated, the region to be contacted with the document may be switched from the first contact surface 1411 to the second contact surface 1412, so that the retard roller 1 can be normally operated. In accordance with the present invention, by moving the switching wheel 12 to have the switching wheel 12 rotate in the second rotating direction C2, the first contact surface 1411 is no longer exposed outside the retard roller receptacle 21 but the second contact surface 1412 is exposed outside the retard roller receptacle 21.

Figure 5A:
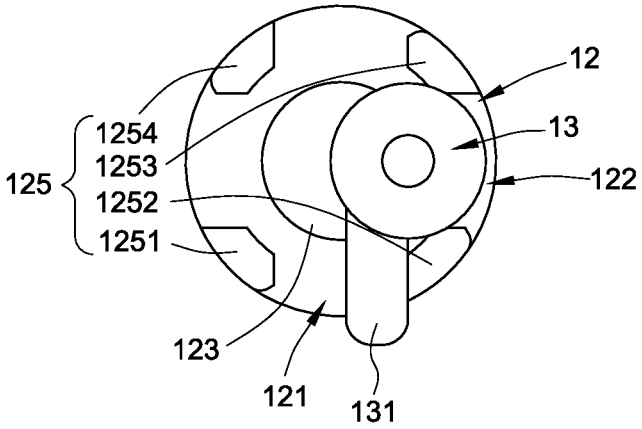
FIGS. 5A, 5B and 5C are schematic side views illustrating the retard roller in the switching status according to the first embodiment of the present invention.
Figure 5B:
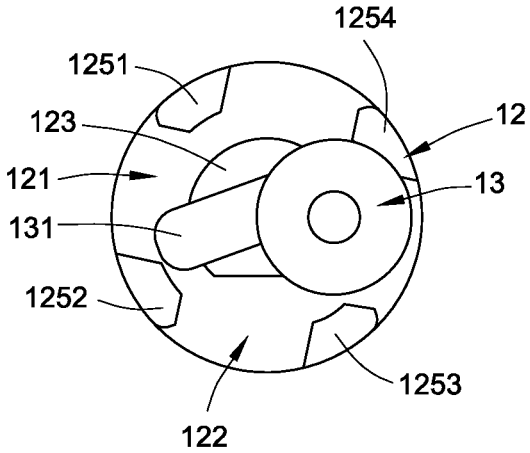
Figure 5C:
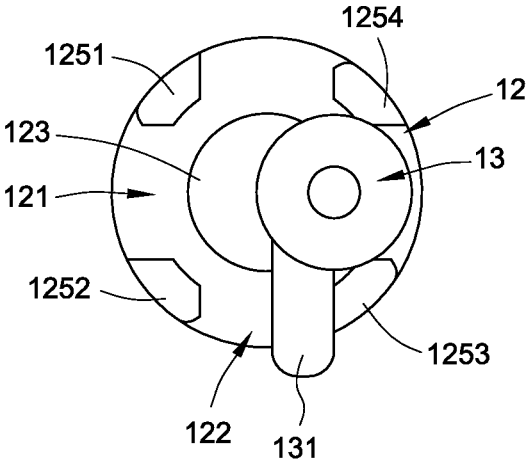

FIGS. 5A, 5B and 5C are schematic side views illustrating the retard roller in the switching status according to the first embodiment of the present invention. As shown in FIG. 5A, the confining part 131 of the stopping rod 13 is inserted into the first locking region 121, which is arranged between the first locking post 1251 and the second locking post 1252. The confining part 131 is confined by the plural locking posts 125 of the switching wheel 12, so that the confining part 131 is only permitted to move within the first locking region 121. In addition, the rotating range of the switching wheel 12 is confined by the plural locking posts 125, so that only the first contact surface 1411 of the retard sleeve member 14 is exposed outside the retard roller receptacle 21. When the switching wheel 12 is rotated in the second rotating direction C2 by sliding the saw-toothed surface 124 of the switching wheel 12, the second locking post 1252 is sustained against the confining part 131. As such, the confining part 131 is also rotated in the second rotating direction C2 and moved toward the left side (taken along the viewpoint of FIG. 5B). Then, the switching wheel 12 is continuously rotated in the second rotating direction C2. Until the second locking post 1252 is no longer sustained against the confining part 131 and the confining part 131 is no longer rotated in the second rotating direction C2, the weight of the confining part 131 causes the confining part 131 to be switched from the leftward position to the downward upright status (taken along the viewpoint of FIG. 5C). That is, the confining part 131 is rotated in the first rotating direction C1 to a small extent. As the switching wheel 12 is continuously rotated in the second rotating direction C2, the confining part 131 is inserted into the second locking region 122, which is arranged between the second locking post 1252 and the third locking post 1253. During the switching wheel 12 is rotated in the second rotating direction C2, the rotating shaft 11 is synchronously rotated with the switching wheel 12. When the confining part 131 is moved from the first locking post 1251 to the second locking region 122, the retard sleeve member 14 is synchronously rotated. As such, the first contact surface 1411 is no longer exposed outside the retard roller receptacle 21. Instead, the second contact surface 1412 is exposed outside the retard roller receptacle 21.

Figure 6:
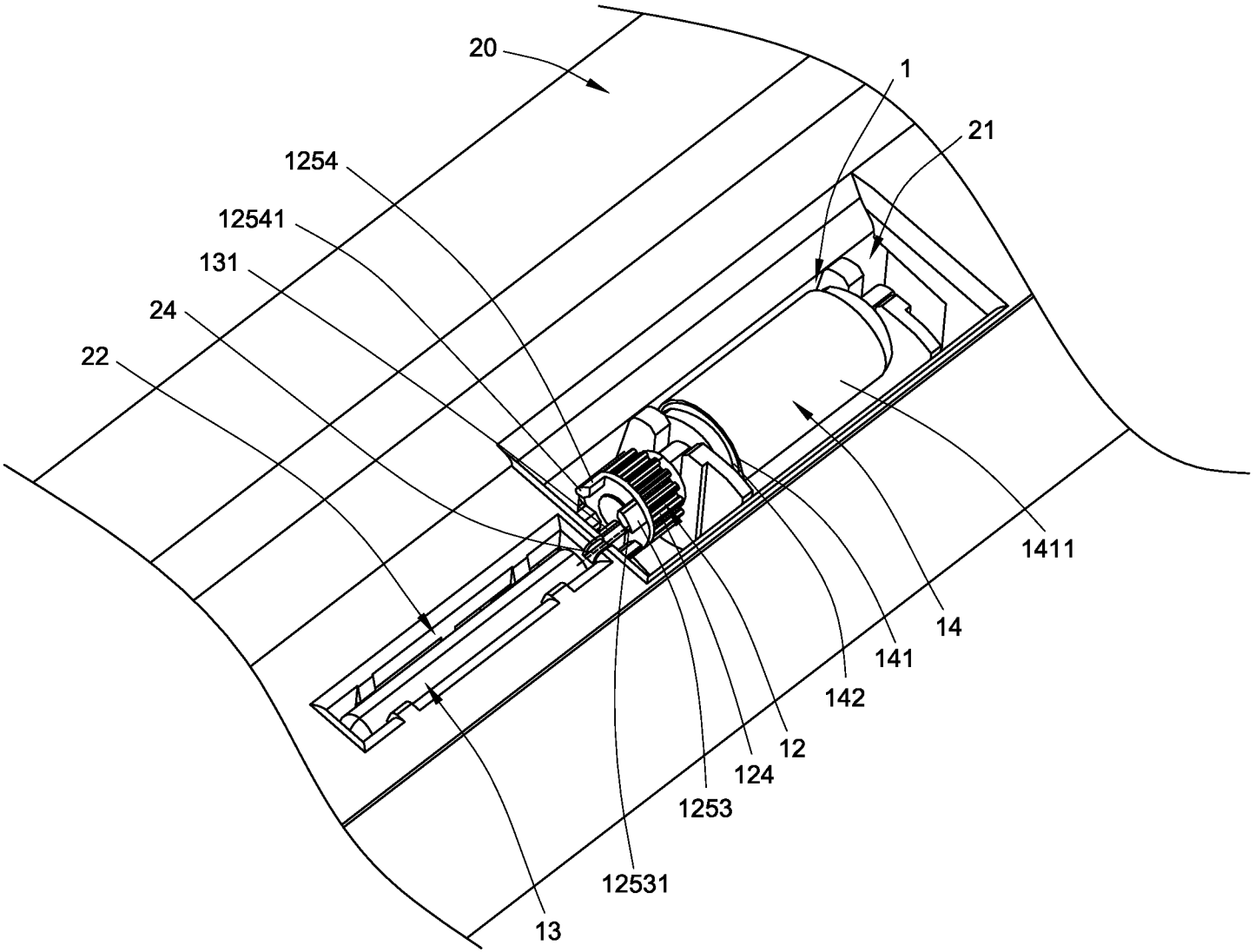
FIG. 6 is a schematic cutaway view illustrating the retard roller installed in the feeder cover of the automatic document feeder according to a first embodiment of the present invention, in which a first mark of the retard roller is aligned with a cover mark of the feeder cover.

FIG. 6 is a schematic cutaway view illustrating the retard roller installed in the feeder cover of the automatic document feeder according to a first embodiment of the present invention, in which a first mark of the retard roller is aligned with a cover mark of the feeder cover. As shown in FIG. 6, the feeder cover 2 has a cover mark 24. The third locking post 1253 has a first mark 12531. The fourth locking post 1254 has a second mark 12541. In a case that the first mark 12531 is aligned with the cover mark 24, the first contact surface 1411 of the retard sleeve member 14 is exposed outside the retard roller receptacle 21 (see FIG. 6). Whereas, in a case that the second mark 12541 is aligned with the cover mark 24, the second contact surface 1412 is exposed outside the retard roller receptacle 21. By means of the first mark 12531 and the second mark 12541, the user can realize whether the first contact surface 1411 or the second contact surface 1412 is completely exposed outside the retard roller receptacle 21. As such, the user can further realize whether the confining part 131 is inserted into the first locking region 121 or the second locking region 122. In this embodiment, the first mark 12531 is a green paint coated on the third locking post 1253, and the second mark 12541 is a yellow paint coated on the fourth locking post 1254. Due to the two different colors, the user can discriminate whether the first locking region 121 or the second locking region 122 is exposed outside the retard roller receptacle 21.

Since the retard sleeve member 14 comprises the first-layered retard sleeve 141 and the second-layered retard sleeve 142, some specified purposes are achieved. That is, if the first-layered retard sleeve 141 corresponding to the first contact surface 1411 is abraded off and the second-layered retard sleeve 142 is exposed outside the retard sleeve member 14, the user may realize that the first contact surface 1411 is abraded off and fails to be normally operated. Once the user finds that the second-layered retard sleeve 142 is exposed outside the retard sleeve member 14, the user needs to rotate the switching wheel 12 in order to expose the second contact surface 1412 outside the retard roller receptacle 21. In some embodiments, the first-layered retard sleeve 141 is made of black rubbery material, and the second-layered retard sleeve 142 is made of red rubbery material. In this situation, the second-layered retard sleeve 142 becomes more conspicuous to be examined.

Figure 7:
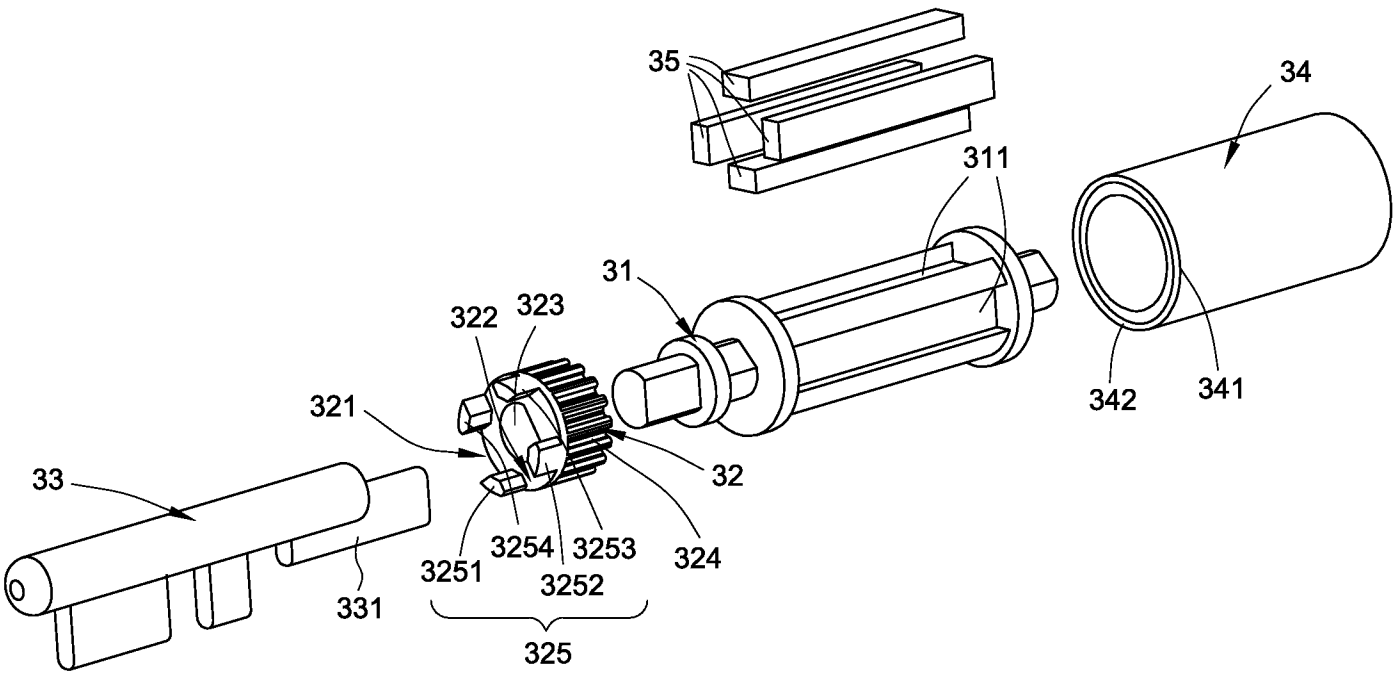
FIG. 7 is a schematic exploded view illustrating a retard roller according to a second embodiment of the present invention.

During the process of feeding the documents, the sheet pick-up module is lowered down. Generally, the contact area between the contact surface of the retard roller and the contact surface of the document is substantially as large as a line. This tiny contact area may result in failure of separating the documents. Especially when the contact surface is abraded, the possibility of causing sheet-separation failure is largely increased. For solving this drawback, the present invention further provides a retard roller having an increased contact surface. FIG. 7 is a schematic exploded view illustrating a retard roller according to a second embodiment of the present invention. The outward appearance of the retard roller 3 of FIG. 7 is substantially similar to that of retard roller 1 of the first embodiment. Whereas, the internal configurations of the retard roller 3 and the retard roller 1 are different. The feeder cover and the stopping rod are similar to those of the first embodiment, and are not redundantly described herein. As shown in FIG. 7, the retard roller 3 comprises a rotating shaft 31, a switching wheel 32, a stopping rod 33, a retard sleeve member 34 and plural soft elements 35. The soft elements 35 are disposed on the rotating shaft 31 and contacted with the retard sleeve member 34. The uses of the soft elements 35 can facilitate increasing the contact area between the second document (not shown) and the retard sleeve member 34. In this embodiment, the soft elements 35 have rectangular shapes. The soft elements 35 are made of soft materials such as sponge, soft rubbery material, ethylene vinyl acetate (EVA) material or ethylene propylene diene (EPDM) material. The rotating shaft 31 has plural grooves 311 for receiving corresponding soft elements 35. When the sheet pick-up module is lowered and the retard roller 3 is sustained against the document, the region of the retard sleeve member 34 that is contacted with the document will be sunken because the soft elements 35 within the retard roller 3 are made of soft material. The sunken profile of the retard sleeve member 34 is determined by the shape of the soft element 35. That is, the sunken profile of the retard sleeve member 34 is substantially rectangular. Since the contact area between the contact surface of the retard roller and the contact surface of the document is changed from the linear shape to a rectangular shape, the sheet separating efficacy of the retard roller 3 is enhanced.

Figure 8:
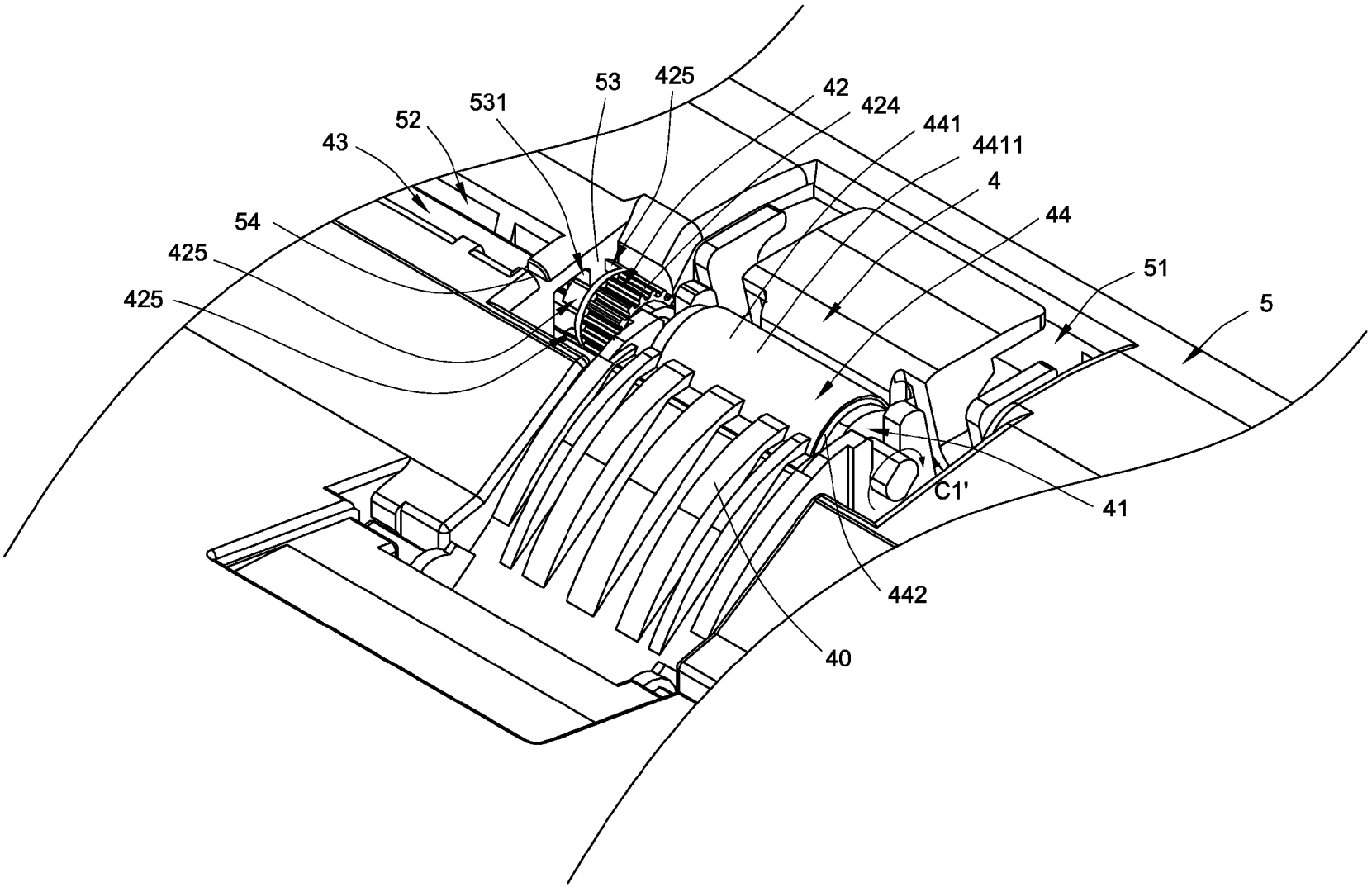
FIG. 8 is a schematic cutaway view illustrating a retard roller module installed in a feeder cover of an automatic document feeder according to a third embodiment of the present invention.
Figure 9:
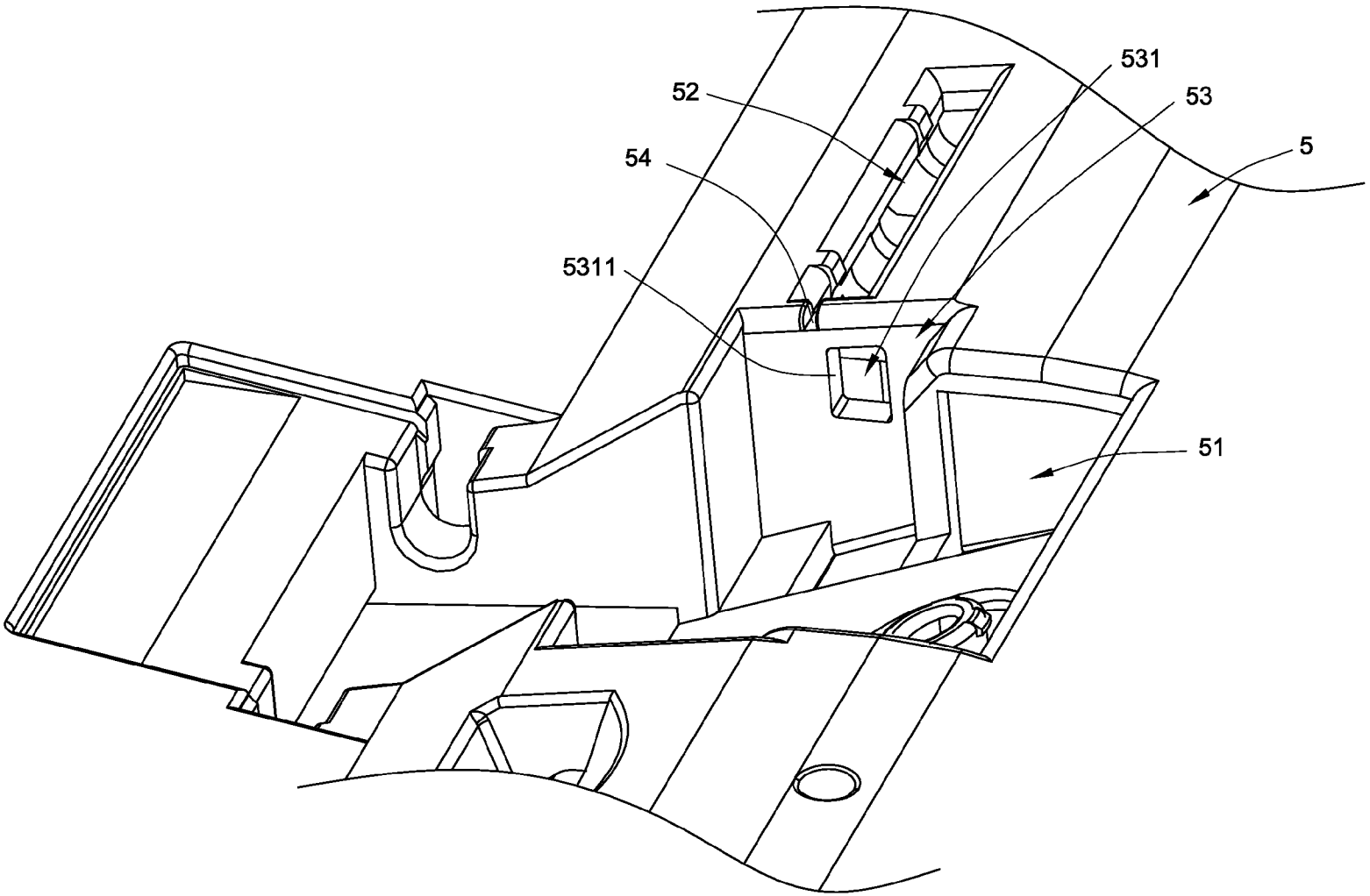
FIG. 9 is a schematic cutaway view illustrating the feeder cover of the automatic document feeder according to the third embodiment of the present invention.

The present invention further provides a retard roller module. FIG. 8 is a schematic cutaway view illustrating a retard roller module installed in a feeder cover of an automatic document feeder according to a third embodiment of the present invention. FIG. 9 is a schematic cutaway view illustrating the feeder cover of the automatic document feeder according to the third embodiment of the present invention. Please refer to FIGS. 8 and 9. The retard roller module 4 is installed in the feeder cover 5 of the automatic document feeder. The retard roller module 4 comprises a module casing 40, a rotating shaft 41, a switching wheel 42, a stopping rod 43, a retard sleeve member 44 and plural soft elements 45. The feeder cover 5 comprises a retard roller module receptacle 51, a receiving structure 52, a receptacle sidewall 53 and a cover mark 54. The receiving structure 52 is arranged beside the retard roller module receptacle 51. The receptacle sidewall 53 is arranged between the retard roller module receptacle 51 and the receiving structure 52. A position-limiting hole 531 is formed in the receptacle sidewall 53. The position-limiting hole 531 has a blocking part 5311. In this embodiment, the blocking part 5311 is a position-limiting hole sidewall. The retard roller module 4 is disposed within the retard roller module receptacle 51. The stopping rod 43 of the retard roller module 4 is accommodated within the receiving structure 42. The stopping rod 43 is penetrated through the position-limiting hole 431 and connected with the switching wheel 42.

Figure 10:
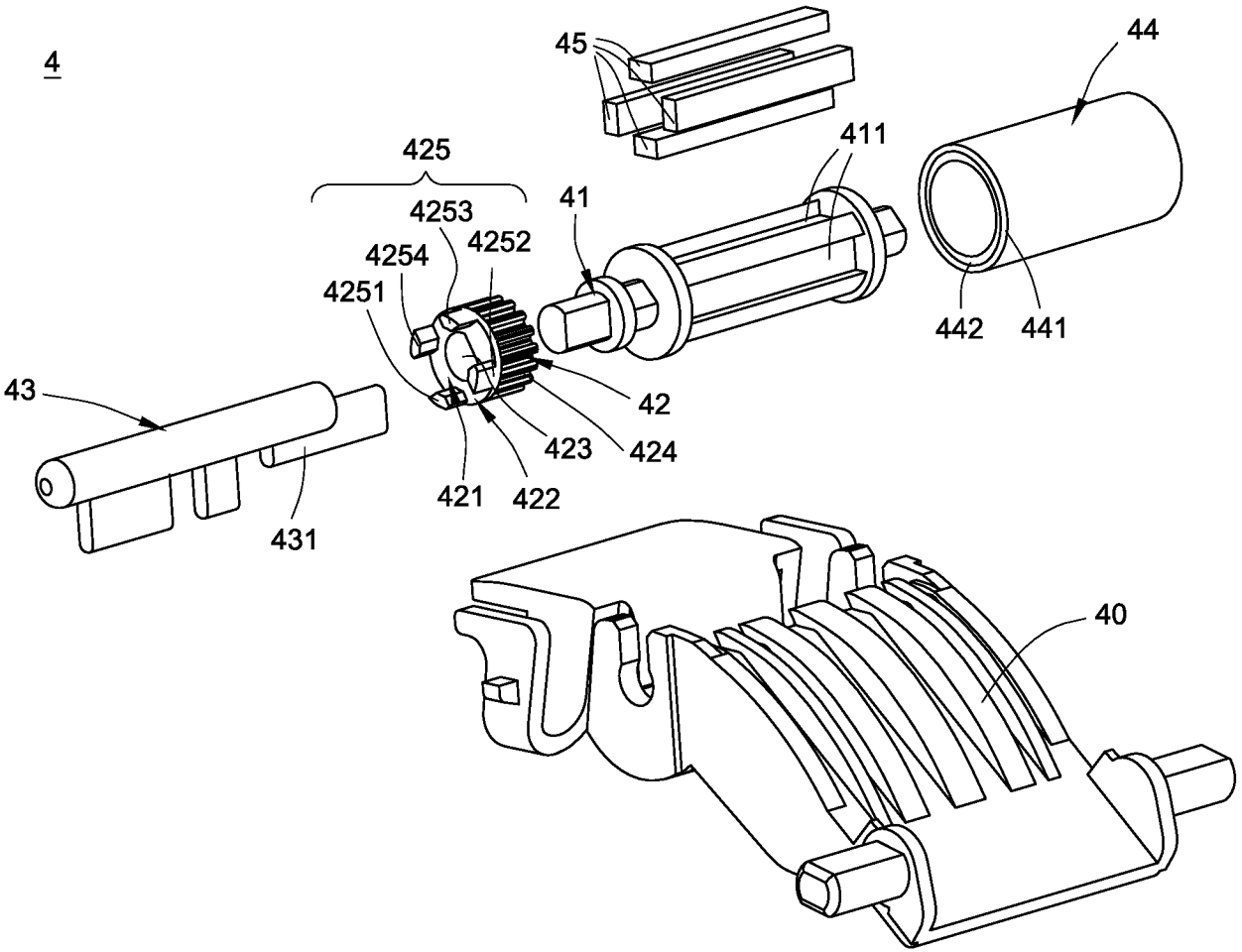
FIG. 10 is a schematic exploded view illustrating the retard roller module according to a third embodiment of the present invention.

FIG. 10 is a schematic exploded view illustrating the retard roller module according to a third embodiment of the present invention. Please refer to FIGS. 8 and 10 again. In the retard roller module 4, the module casing 40 is disposed within the retard roller module receptacle 51. The rotating shaft 41 is disposed within the module casing 40. The rotating shaft 41 has plural grooves 411 for receiving corresponding soft elements 45. The switching wheel 42 is disposed beside the rotating shaft 41, connected to the rotating shaft 41, and synchronously rotated with the rotating shaft 41. The switching wheel 42 comprises a first locking region 421, a second locking region 422, a D-shaped pivotal hole 423, a saw-toothed surface 424 and plural locking posts 425. The rotating shaft 41 is penetrated through the D-shaped pivotal hole 423, so that the switching wheel 42 and the rotating shaft 41 are connected with each other and the switching wheel 42 is synchronously rotated with the rotating shaft 41. The saw-toothed surface 424 may provide a surface frictional force to facilitate the user to rotate the switching wheel 42. The plural locking posts 425 comprise a first locking post 4251, a second locking post 4252, a third locking post 4253 and a fourth locking post 4254. The first locking post 4251 and the second locking post 4252 collectively define the first locking region 421. The second locking post 4252 and the third locking post 4253 collectively define the second locking region 422. The third locking post 4253 has a first mark (not shown). The fourth locking post 4254 has a second mark (not shown). In a case that the first mark is aligned with the cover mark 54, the first contact surface 4411 of the retard sleeve member 44 is exposed outside the retard roller module receptacle 51. Whereas, in a case that the second mark is aligned with the cover mark 44, the second contact surface (not shown) is exposed outside the retard roller module receptacle 51.

The stopping rod 43 is disposed within the receiving structure 52. The stopping rod 43 comprises a confining part 431. The confining part 431 is inserted into the first locking region 421 or the second locking region 422 of the switching wheel 42. Since the confining part 431 is blocked by the blocking part 4311, the stopping rod 43 is hindered from rotating in a first rotating direction C1'. The stopping rod 43 is penetrated through the position-limiting hole 531 and inserted into the switching wheel 42. The retard sleeve member 44 is sheathed around the rotating shaft 41. When the document is transported into the internal portion of the automatic document feeder, the retard sleeve member 44 is contacted with the document to generate a frictional force.

The retard sleeve member 44 comprises a first-layered retard sleeve 441 and a second-layered retard sleeve 442. The second-layered retard sleeve 442 is enclosed by the first-layered retard sleeve 441. The first-layered retard sleeve 441 has a first contact surface 4411 and a second contact surface (not shown). The first contact surface 4411 is exposed outside the retard roller module receptacle 51 (see FIG. 8). The plural locking posts 425 are sustained against the confining part 431 to confine the rotating range of the switching wheel 42, so that only the first contact surface 4411 of the retard sleeve member 44 is exposed outside the retard roller module receptacle 51. The configurations and connecting relations of the components included in the retard roller module 4 are similar to those illustrated in the first and second embodiments, and are not redundantly described herein.

Figure 11A:
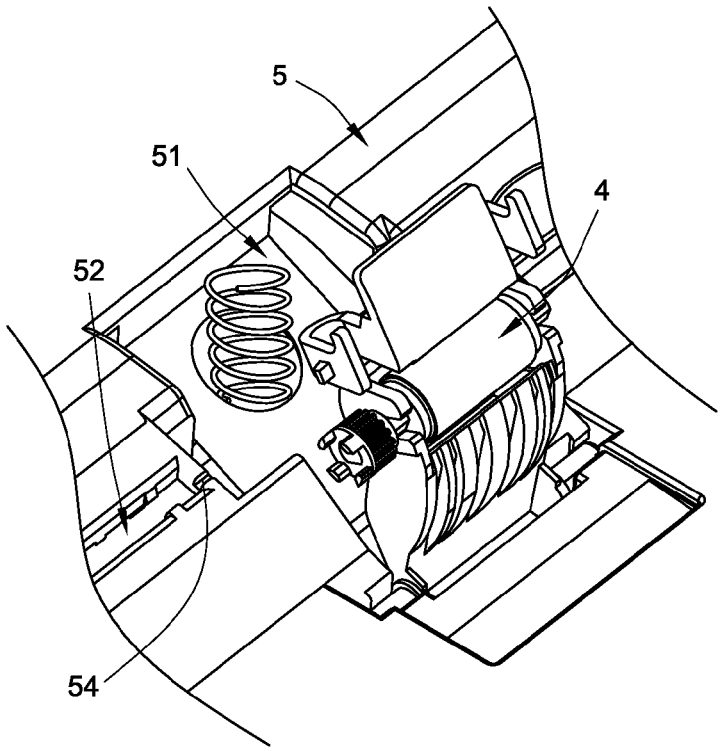
FIGS. 11A and 11B are schematic cutaway views illustrating the processes of disassembling and assembling the retard roller module according to the third embodiment of the present invention.
Figure 11B:
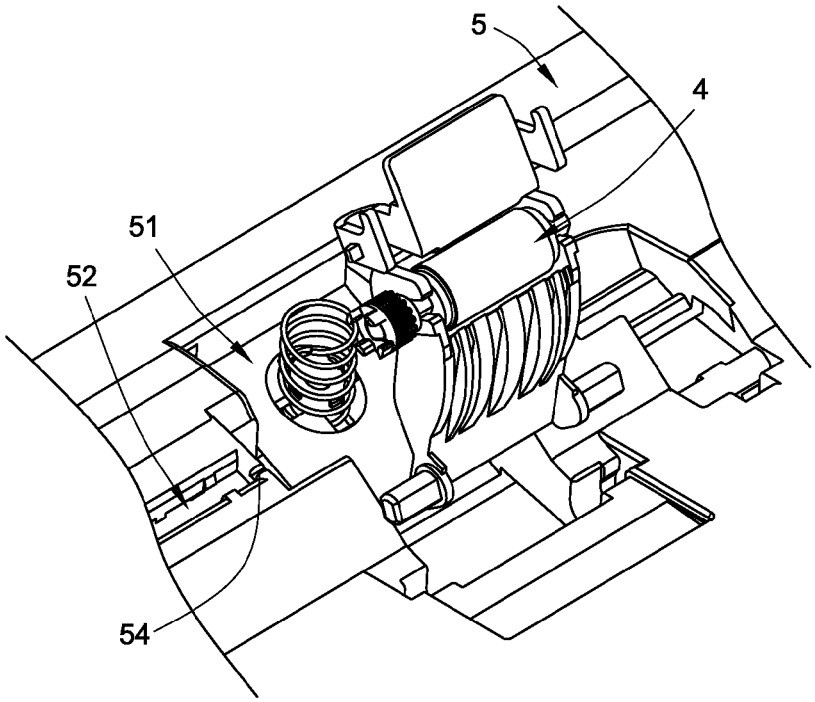

The retard roller module 4 is easily disassembled and assembled. Please refer to FIGS. 8, 11A and 11B. FIGS. 11A and 11B are schematic cutaway views illustrating the processes of disassembling and assembling the retard roller module according to the third embodiment of the present invention. As shown in FIG. 8, the retard roller module 4 is installed in the feeder cover 5 of the automatic document feeder. For disassembling the retard roller module 4 from the feeder cover 5, the both ends of the rotating shaft 41 are firstly held by the user's hands, then the retard roller module 4 is turned forwardly (see FIG. 11A), and finally the retard roller module 4 is vertically removed from the feeder cover 5 to disassemble the retard roller module 4 (see FIG. 11B). On the other hand, for assembling the retard roller module 4 in the feeder cover 5, the steps as described in FIGS. 11B, 11A and 8 are sequentially done.

From the above description, the retard sleeve member of the retard roller or the retard roller module of the present invention has two layers of retard sleeve surfaces to achieve the function of indicating the abraded condition of the retard roller. According to the abraded condition of the retard roller, the user can realize whether the abraded zone of the retard roller needs to be replaced with a new one so as to obviate the drawbacks encountered from the prior art. The retard roller has plural contact surfaces. During each sheet-feeding process, only a contact surface is contacted with the document, and the abraded zone is restricted to a specified contact surface for facilitating the user to monitoring the abraded condition of the retard roller. Moreover, since the retard roller module is easily disassembled and assembled, the retard sleeve member can be replaced with a new one without difficulty.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A retard roller of an automatic document feeder for providing a frictional force to separate a first document and a second document from each other, said first document lying on said second document, said retard roller being disposed in a feeder cover of said automatic document feeder, said feeder cover comprising a retard roller receptacle and a receiving structure beside said retard roller receptacle, said retard roller comprising:

a rotating shaft disposed within said retard roller receptacle and rotatable with respect to said feeder cover;

a switching wheel disposed beside said rotating shaft, connected to said rotating shaft, and synchronously rotated with said rotating shaft, wherein said switching wheel has a first locking region and a second locking region;

a stopping rod disposed within said receiving structure, and comprising a confining part, wherein said confining part is inserted into said first locking region or said second locking region of said switching wheel, and said confining part is blocked by a blocking part, so that said stopping rod is hindered from rotating in a first rotating direction;

a retard sleeve member sheathed around said rotating shaft, and having a first contact surface exposed outside said retard roller receptacle, and plural soft elements disposed on said rotating shaft and contacted with said retard sleeve member for increasing a contact area between said second document and said retard sleeve member, wherein each of said soft elements has a rectangular shape, and wherein said rotating shaft further comprises plural grooves for receiving corresponding soft elements;

wherein when said first document and said second document are transported into said automatic document feeder, said retard sleeve member is contacted with said second document to generate said frictional force, wherein when said second document is moved in a sheet-feeding direction, said stopping rod is blocked by said blocking part to hinder said rotating shaft from rotating in said first rotating direction, so that said first contact surface is still exposed outside said retard roller receptacle, wherein when said rotating shaft is rotated in a second rotating direction reverse to said first rotating direction, said stopping rod is rotated in said second rotating direction in response to rotation of said rotating shaft, and said confining part is moved from said first locking region to said second locking region, so that a second contact surface is exposed outside said retard roller receptacle.

2. The retard roller according to claim 1 wherein said feeder cover further comprises a position-limiting hole, which is formed in a receptacle sidewall between said receiving structure and said retard roller receptacle, wherein a position-limiting hole sidewall of said position-limiting hole is served as said blocking part for hindering said stopping rod from rotating in said first rotating direction.

3. The retard roller according to claim 1 wherein each of said soft elements is made of sponge, soft rubbery material, ethylene vinyl acetate (EVA) material or ethylene propylene diene (EPDM) material.

4. A retard roller module of an automatic document feeder for providing a frictional force to separate a first document and a second document from each other, said first document lying on said second document, said retard roller being disposed in a feeder cover of said automatic document feeder, said feeder cover comprising a retard roller module receptacle and a receiving structure beside said retard roller module receptacle, said retard roller module comprising:

a module casing disposed within said retard roller module receptacle;

a rotating shaft disposed within said module casing and rotatable with respect to said module casing;

a switching wheel disposed beside said rotating shaft, connected to said rotating shaft, and synchronously rotated with said rotating shaft, wherein said switching wheel has a first locking region and a second locking region;

a stopping rod disposed within said receiving structure, and comprising a confining part, wherein said confining part is inserted into said first locking region or said second locking region of said switching wheel, and said confining part is blocked by a blocking part, so that said stopping rod is hindered from rotating in a first rotating direction;

a retard sleeve member sheathed around said rotating shaft, and having a first contact surface exposed outside said retard roller module receptacle, and plural soft elements, which are disposed on said rotating shaft and contacted with said retard sleeve member for increasing a contact area between said second document and said retard sleeve member, wherein each of said soft elements has a rectangular shape, and wherein said rotating shaft further comprises plural grooves for receiving corresponding soft elements;

wherein when said first document and said second document are transported into said automatic document feeder, said retard sleeve member is contacted with said second document to generate said frictional force, wherein when said second document is moved in a sheet-feeding direction, said stopping rod is blocked by said blocking part to hinder said rotating shaft from rotating in said first rotating direction, so that said first contact surface is still exposed outside said retard roller module receptacle, wherein when said rotating shaft is rotated in a second rotating direction reverse to said first rotating direction, said stopping rod is rotated in said second rotating direction in response to rotation of said rotating shaft, and said confining part is moved from said first locking region to said second locking region, so that a second contact surface is exposed outside said retard roller module receptacle.

5. The retard roller module according to claim 4 wherein each of said soft elements is made of sponge, soft rubbery material, ethylene vinyl acetate (EVA) material or ethylene propylene diene (EPDM) material.

6. The retard roller module according to claim 4 wherein said feeder cover further comprises a position-limiting hole, which is formed in a receptacle sidewall between said receiving structure and said retard roller module receptacle, wherein a position-limiting hole sidewall of said position-limiting hole is served as said blocking part for hindering said stopping rod from rotating in said first rotating direction.

* * * * *